US006536352B1

(12) United States Patent
Nadkarni et al.

(10) Patent No.: US 6,536,352 B1
(45) **Date of Patent: *Mar. 25, 2003**

(54) LEAD-FREE FRANGIBLE BULLETS AND PROCESS FOR MAKING SAME

(75) Inventors: Anil V. Nadkarni, Chapel Hill, NC (US); John T. Abrams, Raleigh, NC (US)

(73) Assignee: Delta Frangible Ammunition, LLC, Stafford, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/569,060

(22) Filed: May 10, 2000

Related U.S. Application Data

(63) Continuation-in-part of application No. 08/678,776, filed on Jul. 11, 1996, now Pat. No. 6,074,454.
(60) Provisional application No. 60/181,267, filed on Feb. 9, 2000.

(51) Int. Cl.[7] ..... F42B 8/14; F42B 12/74
(52) U.S. Cl. ..... 102/506; 102/517
(58) Field of Search ..... 419/38; 102/445, 102/506, 517

(56) References Cited

U.S. PATENT DOCUMENTS

| | | | | |
|---|---|---|---|---|
| 2,409,307 | A | | 10/1946 | Patch et al. |
| 2,995,090 | A | | 8/1961 | Daubenspeck |
| 3,123,003 | A | | 3/1964 | Lange, Jr. et al. |
| 3,326,133 | A | | 6/1967 | Stadler et al. |
| 3,650,213 | A | | 3/1972 | Abbott et al. |
| 3,972,286 | A | | 8/1976 | Canon |
| 4,005,660 | A | | 2/1977 | Pichard |
| 4,165,692 | A | | 8/1979 | Dufort et al. |
| 4,881,465 | A | | 11/1989 | Hooper et al. |
| 4,949,645 | A | | 8/1990 | Hayward et al. |
| 5,062,974 | A | | 11/1991 | Van Meter |
| 5,069,869 | A | | 12/1991 | Nicolas et al. |
| 5,078,054 | A | | 1/1992 | Ashok et al. |
| 5,237,930 | A | | 8/1993 | Belanger et al. |
| 5,279,787 | A | | 1/1994 | Oltrogge |
| 5,349,907 | A | | 9/1994 | Petrovich et al. |
| 5,399,187 | A | | 3/1995 | Mravic et al. |
| 5,442,989 | A | | 8/1995 | Anderson |
| 5,527,376 | A | | 6/1996 | Amick et al. |
| 5,616,642 | A | | 4/1997 | West et al. |
| 5,679,920 | A | | 10/1997 | Hallis et al. |
| 5,760,331 | A | | 6/1998 | Lowden et al. |
| 5,767,438 | A | | 6/1998 | Lang et al. |
| 5,814,759 | A | | 9/1998 | Mravic et al. |
| 5,852,255 | A | | 12/1998 | Hallis et al. |
| 5,852,858 | A | | 12/1998 | Hallis et al. |
| 5,894,645 | A | | 4/1999 | Hallis et al. |
| 6,074,454 | A | * | 6/2000 | Abrams et al. ..... 75/247 |
| 6,090,178 | A | | 7/2000 | Benini |
| 6,101,949 | A | | 8/2000 | Maucourt et al. |
| 6,257,149 | B1 | | 7/2001 | Cesaroni |

FOREIGN PATENT DOCUMENTS

| | | |
|---|---|---|
| EP | 578981 | 1/1994 |
| GB | 531 389 | 1/1941 |
| GB | 1007227 | 10/1965 |
| GB | 2278423 | 11/1994 |
| WO | WO 88/09476 | 12/1988 |

OTHER PUBLICATIONS

ASM Handbook, vol. 7, 1984, pp. 121–122, 710–716; 778–801 and 802–813.
Condensed Chemical Dictionary, 10th ed., 1981, pp. 147.
U.S. patent application Ser. No. 09/540,569, filed Mar. 31, 2000. Co–pending application owned by assignee of this application.

* cited by examiner

*Primary Examiner*—Daniel J. Jenkins
(74) *Attorney, Agent, or Firm*—Needle & Rosenberg, P.C.

(57) ABSTRACT

Improved frangible bullets comprising powder particles of one metal bonded together by another metal wherein the metals have substantially different melting points or an alloying metal is diffused between the metal particles are manufactured by compacting the metal particles and heating under conditions to create brittle bonds.

10 Claims, 2 Drawing Sheets

9 MM BULLET – NOMINAL DIMENSIONS

9 MM BULLET – NOMINAL DIMENSIONS

.40 CALIBER BULLET – NOMINAL DIMENSIONS

LEAD-FREE FRANGIBLE BULLETS AND PROCESS FOR MAKING SAME

RELATED U.S. APPLICATION DATA

This application claims priority to U.S. Provisional Application Serial No. 60/181,267, filed on Feb. 3, 2000. The Ser. No. 60/181,267 provisional patent application is incorporated herein by this reference in its entirety.

This application is a continuation in part of Ser. No. 08/678,776, filed on Jul. 11, 1996, now U.S. Pat. No. 6,074,454 issued on Jun. 13, 2000.

FIELD OF THE INVENTION

This invention relates to lead-free frangible bullets having improved frangibility and novel processes for producing these bullets.

BACKGROUND OF THE INVENTION

The advantages and desirability of lead-free frangible bullets is described in co-pending U.S. patent application Ser. No. 08/678,776, filed Jul. 11, 1996, the entire disclosure of which is incorporated by reference herein.

Traditionally bullets for small arms ammunition have been manufactured from lead and lead alloys. The major advantages of lead as a bullet material are its relatively low cost, high density and high ductility. The high density of lead has been particularly important to bullet design because the energy generated by the weight of a bullet is critical to the proper functioning of modern semi-automatic and automatic weapons, the in-flight stability of the round, and the terminal effects of the bullet.

The highly toxic nature of lead, however, and its propensity to fume and generate airborne particulate, place the shooter at an extreme health risk. The more a practice firing range is used, the more lead residue builds up, and the greater the resulting lead fume and lead dust pollution (particularly for indoor ranges). Moreover, the lead bullet residue left in the earthen berm of outdoor ranges can leach into the soil and contaminate water tables. In order for indoor ranges to operate safely, extensive and expensive air filtration systems are required. Both indoor and outdoor ranges require constant de-leading. These clean-up operations are time consuming, costly and repetitive. Accordingly, there is a great need for lead-free bullets.

Additionally, personnel at range operations are concerned with the ricochet potential and the likelihood of causing "back-splatter" of the training ammunition. Back-splatter is a descriptive term for the bullet debris that bounces back in the direction of the shooter after a bullet impacts on a hard surface, such as steel targets or backstops. Both ricochets and back splatter present a significant hazard to individuals, equipment and structures in and around live firing ranges. A ricochet can be caused by a glancing impact by a bullet on almost any medium. When a bullet strikes a hard surface at or near right angles, the bullet will either break apart or deform. There is still energy in the bullet mass, however, and that mass and its energy must go somewhere. Since the target material or backstop is impenetrable, the mass bounces back in the direction of the shooter.

It is believed that a key way to minimizing the risk of both ricochet and back-splatter is to maximize the frangibility of the bullet. By designing the bullet to fracture into small pieces, one reduces the mass of each fragment, and in turn the overall destructive energy remaining in the fragments.

Several prior art patents disclose materials and methods for making non-toxic or frangible bullets or projectiles. For example, U.S. Pat. No. 5,442,989 to Anderson discloses projectiles wherein the casing is frangible and made out of molded stainless steel powder or a stainless steel plus pure iron powder mix with up to 2% by weight of graphite. The casing encloses a penetrator rod made of a hard material such as tungsten or tungsten carbide. This projectile is mainly for 20–35 mm cannons to engage targets such as armored vehicles, trucks, buildings, ships, etc. Upon impact against the target, the casing produces fragments which are thrown in all directions with great energy while the penetrator rod pierces the target.

U.S. Pat. No. 4,165,692 to Dufort discloses a projectile with a brittle sintered metal casing having a hollow interior chamber defined by a tapering helix with sharp edge stress risers which provide fault lines and cause the projectile to break up into fragments upon impact against a hard surface. The casing is made of pressed iron powder which is then sintered. This projectile is also designed for large caliber rounds such as 20 mm cannon shots.

U.S. Pat. No. 5,399,187 to Mravic et. al discloses a lead-free bullet which comprises sintered composite having one or more high density powders selected from tungsten carbide, ferrotungsten, etc., and a lower density constituent selected from tin, zinc, iron, copper or a plastic matrix material. These composite powders are pressed and sintered. The high density constituent allows bullet densities approaching 9 g/cm$^3$.

U.S. Pat. No. 5,078,054 to Sankaranarayanan et. al discloses a frangible projectile comprising a body formed from iron powder with 2 to 5% by weight of graphite or iron with 3 to 7% by weight of $A_2O_3$. The powders are compacted by cold pressing in a die or isostatic pressing, and then sintered.

U.S. Pat. No. 5,237,930 to Belanger et. al discloses a frangible practice ammunition comprising compacted mixture of fine copper powder and a thermoplastic resin selected from nylon 11 and nylon 12. The copper content is up to about 93% by weight. The bullets are made by injection molding and are limited to densities of about 5.7 g/cm$^3$. A typical 9 mm bullet only weighs about 85 grains.

An objective of this invention is to provide a range of lead-free frangible bullets, optimized for frangibility, which will eliminate the lead fumes and dust hazard to the shooter while also minimizing the ricochet and back-splatter hazards. A further objective is to provide a low cost material and process for making such a bullet. Yet another objective is to provide a bullet with a weight and density as high and as close to the conventional lead bullet as possible so that the recoil and the firing characteristics closely resemble those of conventional lead bullet. Yet another objective is to reduce the risk of lead residues leaching into the soil and water table in and around shooting ranges.

Another objective of this invention includes providing processes of manufacturing frangible bullets that enable the production of compacted bullets with extremely small dimensional changes occurring between the pressed compact and the final product, thus making it much easier to predict finished product bullet dimensions. An additional objective of this invention is the avoidance of high sintering temperatures and times and the associated high energy costs.

SUMMARY OF THE INVENTION

The present invention provides frangible bullets or projectiles and materials and processes for the manufacture of such bullets and projectiles. More particularly, the bullets of the present invention comprise a compact of powder particles of a first (matrix) metal bonded together with a binder of a second (binder) metal.

In a preferred embodiment of the invention, the bullets comprise a compact of matrix metal powder particles having a higher melting point bonded together by a binder metal having a substantially lower melting point. More particularly, the matrix metal powder particles are "wet" by the binder metal thereby binding them together.

The bullets of this preferred embodiment may be manufactured by a novel process comprising first admixing combinations of two or more lead-free metal powders wherein at least one of the lead-free metal powders (binder) has a melting point substantially lower than that of the other metal powder (matrix) present. A pressed compact of the admixture of metal powders is formed into the shape of a bullet or projectile as desired, and the pressed compact then is heated under conditions effective to reach the melting point of the lower melting point binder metal to place the lower melting point binder metal into a molten state, or at least a partial molten state, thereby effectively "wetting" the surface of the higher melting point matrix metal powder. The process is effective to bond the compacted powders together with minimal alloying taking place.

In another preferred embodiment of the invention there is provided a frangible bullet comprising a compacted mixture of particles of a first (matrix) metal powder, and particles of a second (binder) metal alloy powder, comprised of at least the matrix metal and an alloying metal, wherein the particles are bonded together by a portion of the alloying metal diffusing into the first metal powder particles.

The bullet of this second preferred embodiment may be manufactured by forming a pressed compact of the particles of the two metal powders in the shape of the bullet desired. The pressed compact is then heated under conditions to diffuse at least a portion of the alloying metal from the alloy and into the particles of the matrix metal powder without substantially melting any of the powder particles. The diffused metal binds the powder particles together.

Wherever particles of a pure metal powder and an alloy metal powder are in contact, atoms of the alloying metal attempt to diffuse into the pure metal. This is due to the natural tendency of the alloying atoms to equally distribute themselves among all atoms of the pure metal. When this phenomenon occurs at temperatures where no melting of any type occurs, it is known as solid-state diffusion. It creates bonds between the individual metal particles and the collective effect of these bonds holds the compacted process together. The process is not limited to mixtures of a pure metal powder and an alloy powder as bonds can be similarly created between particles of two alloy powders.

An advantage of this invention is that the above described "wetting" bonding process and "diffusion" bonding process of manufacturing versus conventional sintering enables the production of compacted bullets with extremely small dimensional changes occurring between the pressed compact and the final product. Thus, it is much easier to predict finished product bullet dimensions. An additional advantage of the process of this invention is the avoidance of high sintering temperatures and times and associated high energy costs.

This invention is more fully explained below in the Detailed Description of preferred embodiments.

DETAILED DESCRIPTION OF THE PREFERRED EMBODIMENTS

Figure 1:
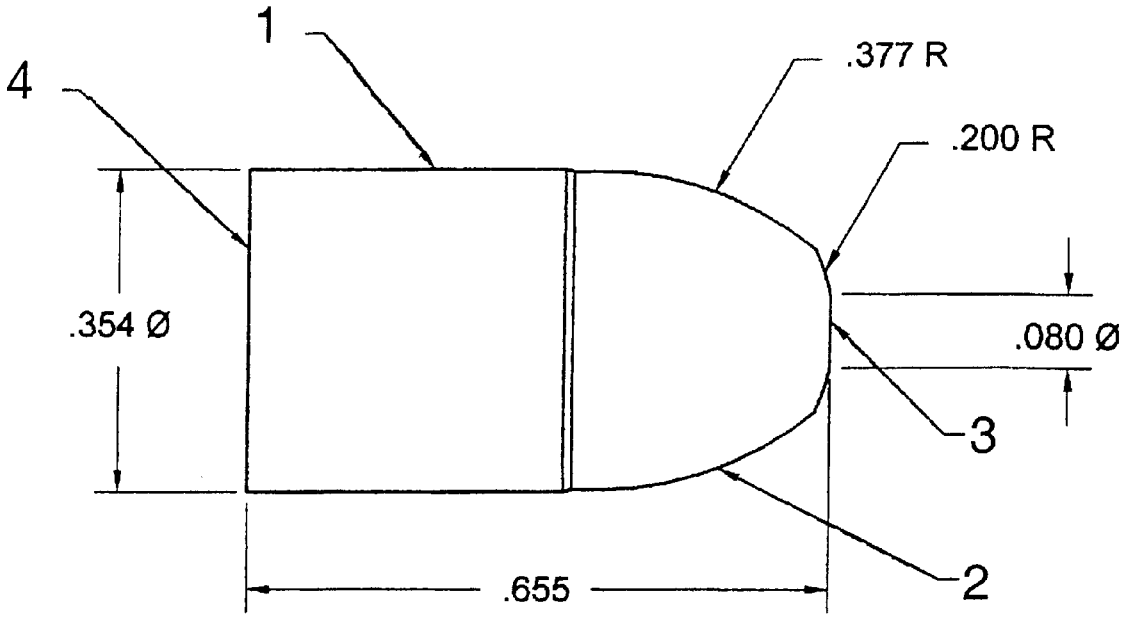
FIG. 1—This figure illustrates a side elevation view, including nominal dimensions, of a typical 9 mm bullet which can be manufactured from the process of this invention.

The embodiments described in this section and illustrated in the drawings are intended as examples only and are not to be construed as limiting of the invention described in the claims or the scope thereof in any way. This invention contemplates the use of any of the many known bullet and projectile designs that could be made using the materials and the processes described in this disclosure. Moreover, the present disclosure is not intended to be a treatise on bullet and projectile manufacturing and readers are referred to appropriate, available texts and other materials in the field for additional and detailed information on bullet manufacture and other aspects of practicing this invention.

Figure 2:
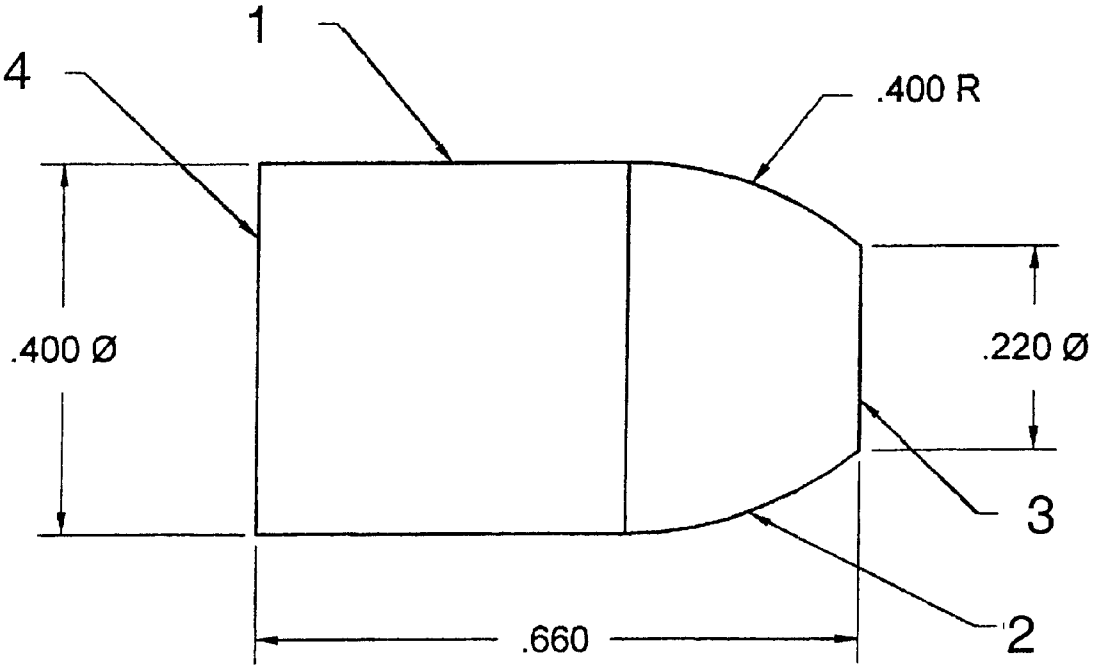
FIG. 2—This figure illustrates a side elevation view, including nominal dimensions, of a typical 0.40 caliber bullet.

Referring now to FIGS. 1 and 2, typical bullets have a cylindrical body (1) with a tapered nose portion (2). The tip of the nose (3) can have various shapes. For example, it may be flat as shown in FIG. 2, radiused as shown in FIG. 1 or spherical for better aerodynamics. The base (4) may be flat or comprise a boat-tail configuration or be in other shapes.

The frangible bullet of the present invention consists of a compact of powder particles of a first (matrix) metal bonded together with a second (binder) metal. Either or both the (matrix) metal and binder metal may be a pure metal or a metal alloy. Also, there may be more than one metal bonded by the binder metal, and there may be more than one metal binder.

In one preferred embodiment of the invention, the frangible bullet comprises one or more higher melting point matrix metal powders held together by a lower melting point binder metal. The matrix metal powder and binder metal do not form an alloy in the conventional sense nor are they sintered together in the conventional sense. Rather the metal binder in effect "solders" the particles of the metal powder together.

By the matrix metal powder particles being bound by a binder metal, the bullet is frangible upon impact against a hard target and yet has sufficient strength and ductility to survive its firing without break-up.

The frangible bullet of the present invention also may consist of two or more metal powders held together by an alloying metal diffused between the powder particles. By varying the time and temperature at which the compacted powders are heated, the degree and strength of the bonding may be controlled to produce a suitably frangible bullet.

The metal powder of the frangible bullet may be any metal or metal alloy and two or more metal or metal alloy powders may be present. Preferably the metal or metal alloy powder is lead-free. By "lead-free" it is meant that the metal or metal alloy contains essentially no lead, though it may contain lead as an impurity or in trace amounts.

In the first preferred embodiment, the metal powder or powders forming the bullet has a melting point suitably higher than the binder.

Examples of suitable higher melting point matrix metals useful in this invention include, without limitation, copper, iron, nickel, cobalt, tungsten, molybdenum, and their alloys.

As a higher melting point metal powder for the bullets of this invention, copper is a preferred material. It is non-toxic and has a reasonably high density—8.96 g/cm$^3$ versus 11.3 g/cm$^3$ for lead. Copper, being soft, also has a lubricating effect on the gun barrel, and thus minimizes barrel wear. Copper powder technologies also offer ways to make bullet and projectile products frangible. Though the metal is very ductile, bullets made of copper powder may be frangible and break-up into small particles and not ricochet upon impact against a hard surface.

Metal alloy powders may be employed as matrix metal in the frangible bullets of the invention. Examples of alloy powders suitable in this embodiment of the invention include, without limitation, bronzes (copper-tin), brasses (copper-zinc), mild steels (iron-carbon), and alloy steels (iron-carbon with nickel, chromium, molybdenum or tungsten). Preferred alloys include bronzes and brasses; most preferred are bronzes.

The binder metal of the frangible bullet may be any metal or metal alloy that will wet the matrix metal powder particles and bind them together. Two or more metals or metal alloys may be present as binder. Preferably, as with the matrix metal powder, the binder metal is lead-free.

The metal binder or binders forming the bullet has a melting point substantially lower than the matrix metal powder.

Examples of suitable lower melting point binder metals useful in this invention include, without limitation, tin, zinc, bithmuth, indium, and their alloys.

Lower melting point binder metal powders preferred for use in this invention include tin because molten tin readily wets the copper powder. The minimal alloying that could occur near the copper particle surfaces forms brittle phases which aid in the frangibility of the bullet.

Metal alloys also may be employed as the binder. Examples of alloy powders that are suitable in this embodiment of the invention include, without limitation, tin-zinc, indium-tin, indium-zinc, antimony-tin, bismuth-tin, and bismuth-zinc. Preferred alloy binders include tin-zinc and indium-tin; most preferred is tin-zinc.

It is preferred that the higher and lower melting point powders differ in melting point range by a magnitude of at least 2 to 1 on the absolute temperature scale (° K). This ensures that no significant alloying and dimensional changes occur during sintering of the bullet.

It has been found that the combination of copper or iron as the matrix metal powder with tin or zinc as the binder metal, produces particularly suitable frangible bullets. More particularly preferred is the combination of copper with tin.

Particle sizes are important in the various admixtures of the desired higher and lower melting point metal powders of this invention to achieve the desired end product. The particle size of the higher melting point matrix metal powder should be such that it may be readily compressed into the shape of a bullet and be economical to produce. The particle size of the lower melting point powder should be as fine as possible to maximize the contact points where the brittle bonds are formed. Finer particle size also aids in a more uniform distribution of the two powders when blended together.

The higher melting point matrix metal powders typically have particle sizes of less than about 850 microns, preferably less than about 250 microns, and most preferably less than about 150 microns.

The lower melting point binder metal powders typically have particle sizes of less than about 150 microns, preferably less than about 44 microns, and most preferably less than about 20 microns.

The instantly inventive bullets may be made by admixing one or more higher melting and lower melting powders thoroughly in predetermined proportions, depending upon the properties of the end product desired. For good frangibility it is important to form as many brittle bonds between the higher melting point matrix metal powder particles and the lower melting point metal binder as possible. The finer the particle size of the lower melting point binder metal powder, the lesser the amount of that powder is needed to achieve adequate frangibility. Generally, it has been found for purposes of enhanced frangibility and prediction of finished product dimensions that it is preferable that the mixture comprise by weight about 2% or more of a lower melting point binder metal powder.

The mixture is placed in a die and compacted into the shape of a bullet or other projectile shape as desired. The compacted mixture is then heated in a furnace under conditions effective to reach the melting point binder metal of a lower melting point binder metal powder present and to place at least a portion of the lower melting binder point binder metal powder into a molten state to effectively wet, or at least partially wet, the surface of the higher melting point matrix metal powders present. In the practice of this invention, it has been found advantageous to heat the admixture in a furnace at a temperature not exceeding about 200° F. above the melting point of the lowest melting point powder present in the admixture to ensure the desired degree of wetting and the desired enhanced frangibility of the products of the invention.

The frangible bullet of a second preferred embodiment of the present invention comprises two or more metal or metal alloy powders held together by an alloying metal diffused between the powder particles.

In the simplest, and preferred, form of this embodiment, two metal powders are selected where one is a pure (matrix) metal and the other (binder) is an alloy of the pure metal and another metal. The powders are thoroughly mixed together in predetermined proportions. The mixture is placed in a die and compacted into the shape of a bullet. The compacted bullet is placed in a furnace and sintered under a non-oxidizing atmosphere at a suitable temperature.

As explained above, wherever particles of the pure metal powder and alloy metal powder contact, atoms of the alloying metal attempt to diffuse into the pure metal. This is due to the natural tendency of the alloying atoms to equally distribute themselves among all atoms of the pure metal. This phenomenon is known as solid-state diffusion when it occurs at temperatures where no melting of any type occurs. Bonds are created between the individual metal particles and the collective effect of these bonds is to bind the compacted powders together.

By varying the temperature and the time that the compacted powders are heated, it is possible to control the degree and strength of bonding between the metal particles. Thus, frangibility can be controlled by creating weak bonds and a more-frangible bullet or strong bonds and a less-frangible bullet.

Powders of pure copper, iron, nickel, cobalt, tungsten and molybdenum, among others, may be suitably employed as the matrix metal powder. Copper, for the same reasons it is preferred in the first embodiment, is preferred in this embodiment.

As stated, an alloy of the pure metal of the matrix metal powder and another alloying metal is preferred as the binder metal alloy powder in the frangible bullets of the invention. Examples of useful alloying metals, include without limitation, tin, zinc, etc. Tin is the most preferred alloying metal. Accordingly, binder metal alloy powders suitable in this embodiment of the invention include, without limitation, bronzes (copper-tin), brasses (copper-zinc), iron, tin, iron-zinc, nickel-zinc, nickel-tin, etc. Preferred alloys include bronzes and brasses; most preferred are bronzes.

A mixture of copper powder and a bronze or brass powder, is particularly preferred in this embodiment of the invention; especially preferred is a mixture of copper powder with bronze powder.

The inventive bullet and process is not limited to mixtures of a pure matrix metal powder and a binder powder which is an alloy of the pure metal in the matrix metal powder and another alloying metal. As bonds can similarly be created between particles of a pure metal powder and an alloy of a different pure metal, and between particles of two alloy powders, such mixtures may be employed usefully in the present invention.

However, it is preferable to select mixtures where one powder has a high concentration of some particular alloying metal that will readily diffuse into the other metal powder(s). A high concentration gradient between the different metal particles promotes the tendency of the alloying atoms to diffuse, enhancing the formation of bonds at lower temperatures. This is an especially important advantage as heating to lower temperatures greatly reduces or eliminates dimensional changes of the compacted bullet. This makes it much easier to achieve the desired finished bullet dimensions.

Thus it is preferred that the alloying metal which binds the metal particles together be present in the binder metal alloy powder in an amount from about 5% to about 70%; more preferably in an amount from 10% to about 50%.

It is also preferred that the particle size of the binder metal alloy powder containing the alloying metal be as fine as possible to maximize the contact points where bonds are formed. Finer particle size also aids in a more uniform distribution of the two powders when blended together. Thus it is preferred that this metal powder have a particle sizes of less than about 150 microns, more preferably less than about 44 microns, and most preferably less than about 20 microns.

The matrix metal or metal alloy powder(s) typically has a particle size of less than about 850 microns, preferably less than about 250 microns, and most preferably less than about 150 microns.

It is preferred in the processes to manufacture the embodiments of this invention that the blended powder admixture is mixed with a suitable lubricant, for example, a stearate or wax. More preferably, this mixture is then cold compacted in a die at a pressure that produces a product having a green strength sufficient to permit handling of the product without chipping.

Heating may be accomplished by any acceptable known process including the use of a box furnace or a belt furnace where heating conditions are controlled by belt speed. Heating is preferably carried out in a protective atmosphere to prevent oxidation.

As is known, a balance must be struck between frangibility and ductility. Products of this invention must have sufficient strength and ductility to withstand the firing operation without breaking up in the barrel of a gun or in flight to a target. It is also desirable that a bullet or projectile have sufficient frangibility so that it breaks up into desirably small pieces upon impact against a hard surface. In accordance with this invention, lower density and lower heating temperature have been found to increase the frangibility while higher density and higher heating temperature have been found to increase ductility. In general, it has been found that copper powder in combination with tin powder compressed to a density of about 7.0 to about 8.5 grams per cubic centimeter, preferably about 8.0 grams per cubic centimeter, and heated at about 500° F. provides a bullet having excellent firing characteristics and frangibility.

Additionally, different users of ammunition may prefer different degrees of frangibility for various reasons. Some prefer to have complete breakup into powder to eliminate any ricochet or back-splatter and minimum penetration of the steel backstop while others will require retention of base pieces sufficiently large to preserve the rifling marks to assist in identifying the weapon which fired the bullet. Some others may prefer breakup into small pieces rather than powder to minimize airborne particles, and at the same time also minimize the ricochet potential.

The technology disclosed in this invention can accommodate most, if not all, of the frangibility requirements. The use of additives to the metal powders also may contribute to the frangibility. Several elements or compounds can be added to the metal powders to increase or decrease frangibility and reduce penetration of and damage to range backstops. One of the objects of these additives is to coat the copper powder particles with inert second phases and thus partially impede the heating process so that the bonds formed between the particles are embrittled. One group of additives are oxides such as $Al_2O_3$, $SiO_2$, $TiO_2$, MgO, $MoO_3$, etc. These may be added in powder form and blended or mechanically milled with the copper powder, or chemically formed by processes such as internal oxidation. One particular embodiment of this invention is to use a commercial $Al_2O_3$ Dispersion Strengthened Copper (DSC) produced by the internal oxidation process. It has been found that the DSC material and copper with mixed $SiO_2$ powder produces bullets with excellent firing characteristics and increased frangibility.

Products prepared by this invention may be repressed or coined after the heating treatment to further increase density, to allow for the production of heavier bullets as desired by using a longer preform and at the same time keeping the overall dimensions of the final bullet or projectile products the same. Optionally, the resulting products may be reheated if necessary to provide higher ductility or reduced frangibility.

Another group of additives is solid lubricants such as graphite, $MoS_2$, MnS, $CaF_2$, etc. It has been found that bullets made using graphite as an additive show good firing characteristics and increased frangibility.

Yet another group of additives is nitrides such as BN, SiN, AIN, etc. Boron nitride in hexagonal crystallographic form (HBN) is preferred as this behaves much like graphite and acts as a solid lubricant. Bullets made with HBN as an additive have good firing characteristics and increased frangibility.

The additives mentioned above can be used in combinations as well. For example, bullets made with graphite and $SiO_2$ additions show good firing characteristics and increased frangibility.

Additionally, carbides such as WC, SiC, TiC, NbC, etc., and borides such as $TiB_2$, $ZrB_2$, $CaB_6$ may also be used to increase the frangibility.

Common copper alloy powders such as brass and bronze can also be used to make the bullets of this invention. These alloys are harder than copper and thus need to be pressed at higher pressures. Some of the additives described above for copper can also be used for brass and bronze powders if necessary to increase the frangibility.

The present invention also may be usefully practiced as products and processes to manufacture products, in addition to bullets and projectiles, where frangibility is a desired characteristic of the products.

EXAMPLES

The following examples illustrate some preferred embodiments of the presently inventive lead-free frangible bullets and processes for producing them.

Example I

A standard grade of copper compacting powder designated as 100 RXH and manufactured by OMG Americas, Inc., Research Triangle Park, N.C., was selected and blended with 5% of an extremely fine tin powder (less than 44 microns). Also included in the blend was 0.25% of Acrawax C, a common powdered compacting lubricant.

The blended powders were molded into .40 caliber×155 grain bullets using a typical powder metallurgy molding press. The molded bullets were heated to 475° F. in a box furnace with an air atmosphere and held for about 30 minutes. After heat treatment, the diameter of the bullets remained essentially the same as that of the original molded bullets.

Examples II & III

Two powder blends were made with one containing 5% tin (particle size less than 44 microns), 0.25% Acrawax C with the balance 100 RXH copper and the other 2.5% tin, 0.25%, Acrawax C with the balance 100 RXH copper. These were similarly molded into .40 caliber×155 grain bullets as described above. Bullets from these two blends were heat treated on a belt furnace under a nitrogen atmosphere with the 5% tin blend heated to 485° F. for about 15 minutes and the 2.5% tin blend heated to about 650° F. for about 15 minutes. After heat treatment, all bullets from either blend had essentially the same diameter as the original molded bullets.

Bullets from all three blends of Examples I, II and III were fired successfully through a .40 caliber handgun. Upon hitting a steel plate target, all bullets shattered into a combination of powder and very small fragments.

Examples IV & V

Two powder blends were made with one containing 80% 150 Regular WC (an in-process copper powder manufactured by OMG Americas, Inc.), 20% PA5050-591 (a bronze alloy powder composed of 50% copper and 50% tin manufactured by OMG Americas, Inc.) and 0.25% Acrawax C. The other powder blend contained 85% 100RXH copper, 15% PA5050-591 bronze alloy and 0.25% Acrawax C.

The powder mixtures described above were blended in a V-cone blender for about 15 minutes. Quantities of .40 caliber×155 grain bullets were compacted from the blends using a typical powder metallurgy molding press. The compacted bullets were then sintered in a belt furnace under a nitrogen atmosphere at about 660° F. for about 15 minutes.

During sintering, the diameters of the bullets shrank only four to five ten-thousandths of an inch, exhibiting good dimensional control.

Thirty bullets from each blend were test fired through a .40 caliber handgun. The target was a flat steel plate of about eight inches in diameter and typical of targets used on modern firing ranges. The distance between the target and the shooter was about eight feet. In all cases, the bullets shattered into powder and small fragments upon striking the target, demonstrating excellent frangibility and safety for the shooter even at this very close firing distance.

What is claimed is:

1. A frangible bullet or projectile manufactured by admixing a lead-free matrix metal powder having a higher melting point with a lead-free metal powder having a melting point substantially lower than the higher melting point of the matrix metal powder, forming a pressed compact of said admixture of powders, and heating said pressed compact under conditions and temperatures effective such that the powder having a lower melting point reaches a molten state and wets said matrix metal powder having a higher melting point and bonds the powders, wherein the binder metal powder having a lower melting point is tin and the matrix powder having a higher melting point is copper.

2. A frangible bullet or projectile of claim 1, wherein the tin powder has a particle size of less than about 150 microns.

3. A frangible bullet or projectile of claim 1, wherein the tin powder has a particle size of less than about 44 microns.

4. A frangible bullet or projectile of claim 1, wherein the copper powder is a dispersion strengthened copper powder.

5. A frangible bullet or projectile manufactured by admixing a lead-free matrix metal powder having a higher melting point with a lead-free metal powder having a melting point substantially lower than the higher melting point of the matrix metal powder, forming a pressed compact of said admixture of powders, and heating said pressed compact under conditions and temperatures effective such that the powder having a lower melting point reaches a molten state and wets said matrix metal powder having a higher melting point and bonds the powders together, wherein the matrix metal powder having a higher melting point comprises prealloyed brass powder containing from 5 to 40 percent by weight of zinc.

6. A frangible bullet or projectile manufactured by admixing a lead-free matrix metal powder having a higher melting point with a lead-free metal powder having a melting point substantially lower than the higher melting point of the matrix metal powder, forming a pressed compact of said admixture of powders, and heating said pressed compact under conditions and temperatures effective such that the powder having a lower melting point reaches a molten state and wets said matrix metal powder having a higher melting point and bonds the powders together, wherein the matrix metal powder having a higher melting point comprises a prealloyed bronze powder containing from 2 to 7 percent by weight of tin.

7. A frangible bullet or projectile manufactured by first compacting a mixture of particles of a matrix metal powder, comprised of at least the matrix metal, and particles of a binder metal alloy powder, comprised of at least the matrix metal and an alloying metal, then heating the pressed compact under conditions to diffuse at least a portion of the alloying metal from the particles of the binder metal alloy powder and into the particles of the matrix metal powder without substantially melting any of the powder particles whereby the particles are bonded together by solid state diffusion, wherein the matrix metal is copper and the binder metal alloy powder is bronze.

8. A frangible bullet or projectile of claim 7, wherein the bronze powder has a particle size of less than about 150 microns.

9. A frangible bullet or projectile of claim 7, wherein the bronze comprises from about 10 to about 50 weight percent tin.

10. A frangible bullet or projectile of claim 7, wherein the compacted mixture comprises from about 2 to about 30 weight percent bronze.

* * * * *

US006536352C1

(12) INTER PARTES REEXAMINATION CERTIFICATE (225th)

United States Patent

Nadkarni et al.

(10) Number: US 6,536,352 C1

(45) Certificate Issued: Jan. 18, 2011

(54) LEAD-FREE FRANGIBLE BULLETS AND PROCESS FOR MAKING SAME

(75) Inventors: Anil V. Nadkarni, Chapel Hill, NC (US); John T. Abrams, Raleigh, NC (US)

(73) Assignee: Delta Frangible Ammunition, LLC, New York, NY (US)

Reexamination Request:
No. 95/000,207, Dec. 15, 2006

Reexamination Certificate for:

| | |
|---|---|
| Patent No.: | **6,536,352** |
| Issued: | **Mar. 25, 2003** |
| Appl. No.: | **09/569,060** |
| Filed: | **May 10, 2000** |

Related U.S. Application Data

(63) Continuation-in-part of application No. 08/678,776, filed on Jul. 11, 1996, now Pat. No. 6,074,454.

(60) Provisional application No. 60/181,267, filed on Feb. 9, 2000.

(51) Int. Cl.

| | |
|---|---|
| ***B22F 1/00*** | (2006.01) |
| ***C22C 1/04*** | (2006.01) |
| ***C22C 32/00*** | (2006.01) |
| ***F42B 12/74*** | (2006.01) |
| ***F42B 12/00*** | (2006.01) |

(52) U.S. Cl. ..... 102/506; 102/517

(58) Field of Classification Search ..... None
See application file for complete search history.

(56) References Cited

U.S. PATENT DOCUMENTS 3,779,714 A * 12/1973 Nadkarni et al. ..... 75/234

FOREIGN PATENT DOCUMENTS

WO WO 00/02689 1/2000

OTHER PUBLICATIONS

ASM Specialty Handbook—Copper and Copper Alloys, pp. 3, 66, and 440 (J.R. Davis ed., 2001).

Powder Technology Handbook, (K. Iinoya et al. ed.) (Marcel Dekker 1991).

Structure and Properties of Engineering Materials, 4th Edition, Brick et al. (McGraw–Hill, 1977).

* cited by examiner

*Primary Examiner*—Jerry D. Johnson

(57) ABSTRACT

Improved frangible bullets comprising powder particles of one metal bonded together by another metal wherein the metals have substantially different melting points or an alloying metal is diffused between the metal particles are manufactured by compacting the metal particles and heating under conditions to create brittle bonds.

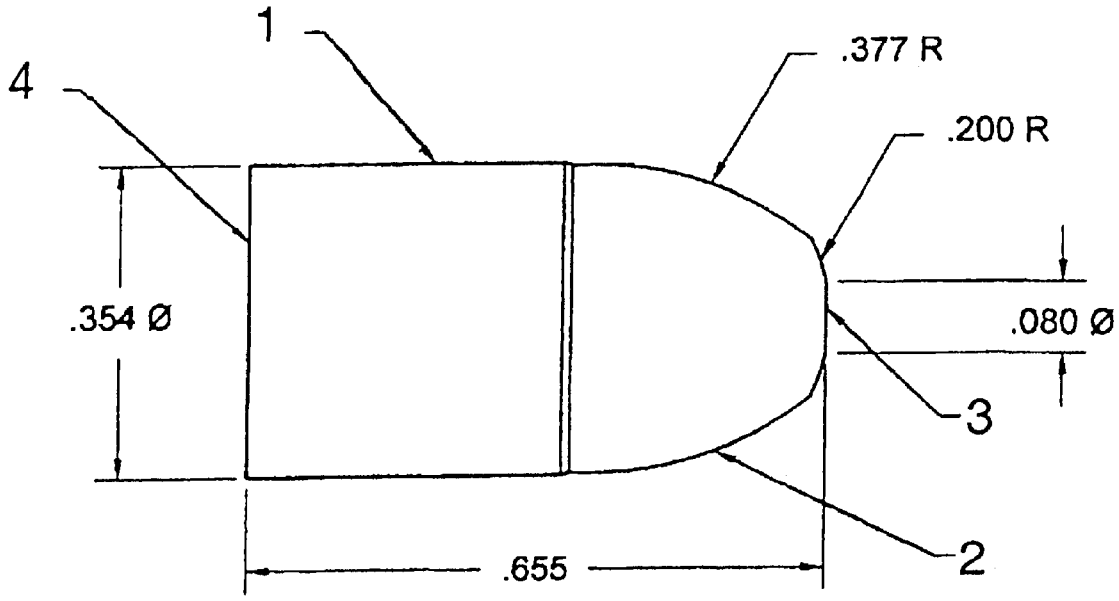

9 MM BULLET – NOMINAL DIMENSIONS

INTER PARTES REEXAMINATION CERTIFICATE ISSUED UNDER 35 U.S.C. 316

THE PATENT IS HEREBY AMENDED AS INDICATED BELOW.

AS A RESULT OF REEXAMINATION, IT HAS BEEN DETERMINED THAT:

Claims 1-6 are cancelled.

Claims 7-10 were not reexamined.

* * * * *